US005380008A

United States Patent [19]

Mathis et al.

[11] Patent Number: 5,380,008

[45] Date of Patent: Jan. 10, 1995

[54] ELECTRONIC GAMING APPARATUS

[75] Inventors: Ricard M. Mathis, Wellington; Richard E. Michaelson, Lemmon Valley, both of Nev.

[73] Assignee: Spintek International, Chattanooga, Tenn.

[21] Appl. No.: 162,501

[22] Filed: Dec. 3, 1993

[51] Int. Cl.[6] ..... A63F 5/04

[52] U.S. Cl. ..... 273/143 R; 273/138 A

[58] Field of Search ..... 273/138 A, 143 R

[56] References Cited

U.S. PATENT DOCUMENTS

| | | | |
|---|---|---|---|
| 4,573,681 | 3/1986 | Okada | 273/143 R |
| 4,657,256 | 4/1987 | Okada | 273/138 A |
| 4,772,023 | 9/1988 | Okada | 273/143 R |
| 5,074,559 | 12/1991 | Okada | 273/143 R |
| 5,083,785 | 1/1992 | Okada | 273/143 R |

*Primary Examiner*—Jessica J. Harrison
*Attorney, Agent, or Firm*—Alan Ruderman

[57] ABSTRACT

Gaming apparatus including a series of rotatable reels having indicia on the peripheries for displaying game results and which are set in motion when the game commences and which stop when the game ends. The gaming apparatus includes a number of computers for controlling the various functions such as the acceptance of a coin inserted into the apparatus, pay out of coins when a game is a winner, the commencement and termination of rotation of the reels, and the determination as to whether a game played is a winning game or a losing game. One of the computers includes a random number generator which generates a first random number that is compared to the hit frequency defined as the probability of a game being a winning game to determine whether the game played is a winner or a loser, and if the game is a losing game, the reels are stopped to display a losing combination. If the game is a winning game, a second random number is generated which is compared to the win probability set to determine the value of the win, and the reels are stopped at positions indicating a winning combination corresponding to the value won.

19 Claims, 6 Drawing Sheets

ELECTRONIC GAMING APPARATUS

BACKGROUND OF THE INVENTION

This invention relates to gaming apparatus and more particularly to that class of gaming apparatus known as slot machines wherein wheels or reels having indicia on the periphery are set into rotation and stop at locations illustrating either a winning or losing combination of the indicia.

Gaming apparatus of this type are those having mechanical wheels or reels which are set into rotation after insertion of one or more coins which activates mechanism to allow a handle to be pulled or a button to be depressed. Thereafter, the reels rotate or spin about a common axis and the rotation is subsequently stopped at angular positions which are indicated by indicia or symbols on the periphery of each reel. The angular positions of the reels determines whether or not there is a win and, if there is a win, the amount of the win or pay-out to the player.

The original reel type gaming apparatus were mechanically controlled. The reels were stopped by a braking device such as an indexing wheel fixed to each reel having a plurality of indexing grooves into which a pin of a tripping arm entered randomly, the arm being actuated by mechanical means including ratchet and pawl and spring means which timed out to release the arms and stop the rotation of the reels in sequence. Pay-outs from the apparatus were made in accordance with a pay-out schedule related to the probability of occurrence of symbols appearing on the reels after stoppage, the symbols appearing through a window on the housing of the apparatus. Subsequent developments in this art provided electromechanical constructions which used similar stopping methods, while more recently electronically operated apparatus have transitioned from control of such tripping arms by relay logic to outputs from signal generators generating a random code of numbers. In these newer electronic devices, solenoid actuated brakes have been controlled to stop each reel in sequence, and the most recent apparatus use a stepper motor to rotatably drive each reel and to stop the rotation at positions determined by a random number generator corresponding to each reel.

In the original mechanically controlled reel gaming apparatus the starting and stopping of the reel rotation occurred substantially in random fashion after the handle was pulled, and thus the particular stopping position of the reels and score was effected on a probability basis. After the reels were stopped the stopped position was detected to determine whether a pay-out was to occur. Accordingly, the hit frequency or probability of a win was based on the laws of probability. The pay-out odds and amount paid out could only be increased if the size of the reels were changed, i.e., made larger, to increase the number of stopping positions and the number of symbols displayed, if the number of reels remained constant. Of course, the number of reels could be increased to increase the odds and pay-out by changing the number of winning combinations. The lowest probability or maximum odds of a pay-out for such apparatus is a function of the number of reels (R) and the number of stop positions (N) on each reel, and is equal to the number of stop positions raised to the power equal to the number of reels, i.e., $N^R$. Subsequent electromechanical apparatus operated on substantially the same basis except that the reels were set in motion by electrical means.

Later developments involving electronic machines utilized the probability or reel position selection resulting from random number generators. For example, Saxton et al U.S. Pat. No. 4,095,795 describes a system having a computer including a random number generator corresponding to each reel, the computer being operable to produce a random number corresponding to positions on the respective reel. The rotation of the reels is stopped at positions determined by the numbers generated. The random code generators simulate a rotation of the respective wheel through the various positions and thereafter the reel rotation is stopped in response to a simulated position. There is one position in memory corresponding to each position on the reel and therefore, the odds of stopping at a particular position, i.e., hitting a single symbol, on each reel is substantially the same as in the mechanical or electromechanical machines. The electronic gaming apparatus of Saxton et al is intended to select the combination randomly at the beginning of a cycle and to preclude disturbing that selection by manually or physically manipulating the machine by shaking or jogging it or the like. Stoppage of the reel rotations at the selected positions is controlled by position sensors and stop signals transmitted to stop solenoids or brakes.

In a later development, in order to change the probability of a hit or the odds for any particular combination to be displayed and therefore increase the pay-out for a jackpot and change the pay-out odds without increasing the size of the reels or the number of reels, Telnaes U.S. Pat. No. 4,448,419 describes an apparatus wherein the random number generators include a greater number of "virtual" positions in memory than there are actual positions on the reels. There is an actual symbol on each reel corresponding to each virtual position in memory, but there are a greater number of virtual positions in memory than there are actual positions or stops on the reels. The random number generator selects a number corresponding to a virtual position and since there are more virtual positions than actual or physical reel positions, the probabilities or odds may be changed by increasing the number of virtual positions corresponding to an actual position without changing the reels. However, there is a finite number of symbols on the virtual reel, or numbers in the random number generator, since each such symbol or number corresponds to or maps back to an actual position on the actual or physical reel. Whether there is a winner or loser and the amount won if a winner occurs is determined by the numbers generated.

In order to select the Hit Frequency, i.e., the wins per play defined as the probability of a win in any amount or the percentage of winning games to total games played, and the Pay-out Percentage, i.e., the return on input defined as the percentage of the total intake into the machine which is paid out to winning players, involves a complex reiterative or trial and error process in any of the apparatus of the prior art. The complexity increases as the number of reels increase and as the number of symbols on the reels increases. For example, consider a traditional game with three reels and twenty stops per reel, and for simplicity such consideration is here limited to a Jackpot Only type of game. This type of game has one symbol type on the reel such as a BAR. The percentage and hit frequency are changed by changing the number of BAR symbols on the reels. Since there are twenty stops on each reel, there are 20×20×20 (or 8000) possible results. If there is only one BAR on each reel only one of the 8000 results will be a winner having three BARS. Assuming a Pay-out of 200 coins, for 8000 coins played (one per game) only 200 coins will be paid out for the one winning result. The Pay-out Percentage is 200/8000 or 2.5%. Also in this case since there is one winning game out of 8000 possible games, the Hit Frequency is 1/8000 or 0.0125%.

These calculations are traditionally performed using a Pay-out table such as the following:

| SYMBOLS | REEL 1 | REEL 2 | REEL 3 | WINS | PAY | COINS OUT |
|---|---|---|---|---|---|---|
| BAR BAR BAR | 1 | 1 | 1 | 1 | 200 | 200 |
| Total | | | | | 200 | |
| Pay-Out Percentage = 200/8000 = 2.5% | | | | | | |
| Hit Frequency = 1/8000 = 0.0125% | | | | | | |

If, for example, a BAR is added to the first reel the Pay-out table becomes:

| SYMBOLS | REEL 1 | REEL 2 | REEL 3 | WINS | PAY | COINS OUT |
|---|---|---|---|---|---|---|
| BAR BAR BAR | 2 | 1 | 1 | 2 | 200 | 400 |
| Total | | | | 2 | | 400 |
| Pay-Out Percentage = 400/8000 = 5.0% | | | | | | |
| Hit Frequency = 2/8000 = 0.025% | | | | | | |

It may be noted that the WINS column is the product of REEL 1×REEL 2×REEL 3. If there are 3 BARS on REEL 1, 4 BARS on REEL 2 and 5 BARS on REEL 3, the Pay-out table becomes:

| SYMBOLS | REEL 1 | REEL 2 | REEL 3 | WINS | PAY | COINS OUT |
|---|---|---|---|---|---|---|
| BAR BAR BAR | 3 | 4 | 5 | 60 | 200 | 12000 |
| Total | | | | 60 | | 12000 |
| Pay-Out Percentage = 12000/8000 = 150% | | | | | | |
| Hit Frequency = 60/8000 = 0.75% | | | | | | |

This game will thus pay out more than it takes in. The designer must now reduce the number of BARS to make the Pay-out Percentage less than 100%. For example, changing the number of BARS on REEL 2 from 4 to 3, and the number of BARS on REEL 3 from 5 to 4, results in the following:

| SYMBOLS | REEL 1 | REEL 2 | REEL 3 | WINS | PAY | COINS OUT |
|---|---|---|---|---|---|---|
| BAR BAR BAR | 3 | 3 | 4 | 36 | 200 | 7200 |
| Total | | | | 36 | | 7200 |
| Pay-out Percentage = 7200/8000 = 90% | | | | | | |
| Hit Frequency = 36/8000 = 0.45% | | | | | | |

This game would be profitable but not popular since with a Hit Frequency of 0.45% a player would win only one of 222 games. To increase the Hit Frequency it is necessary to add lower value pays which have a higher frequency of occurrence. For Example, assuming 2 coins are paid on a single BAR occurring on any reel, and that there are 2 BARS on each reel and that the symbol X stands for a blank the Pay-out table would be as follows:

| SYMBOLS | REEL 1 | REEL 2 | REEL 3 | WINS | PAY | COINS OUT |
|---|---|---|---|---|---|---|
| BAR X X | 2 | 18 | 18 | 648 | 2 | 1296 |
| X BAR X | 18 | 2 | 18 | 648 | 2 | 1296 |
| X X BAR | 18 | 18 | 2 | 648 | 2 | 1296 |
| BAR BAR BAR | 2 | 2 | 2 | 8 | 200 | 1600 |
| Total | | | | 1952 | | 5488 |
| Pay-out Percentage = 5488/8000 = 68.6% | | | | | | |
| Hit Frequency = 1952/8000 = 24.4% | | | | | | |

This would be a more realistic game. The Hit Frequency would be acceptable but the Pay-out Percentage would be too low. Typically Pay-out Percentages should be greater than 80% and Hit Frequency should be 15% or better although this varies with the operator of the game. The effect of adding one BAR to the first reel results in the following table:

| SYMBOLS | REEL 1 | REEL 2 | REEL 3 | WINS | PAY | COINS OUT |
|---|---|---|---|---|---|---|
| BAR X X | 3 | 18 | 18 | 972 | 2 | 1944 |
| X BAR X | 17 | 2 | 18 | 612 | 2 | 1224 |
| X X BAR | 17 | 18 | 2 | 612 | 2 | 1224 |
| BAR BAR BAR | 3 | 2 | 2 | 12 | 200 | 2400 |

-continued

| SYMBOLS | REEL 1 | REEL 2 | REEL 3 | WINS | PAY | COINS OUT |
|---|---|---|---|---|---|---|
| Total | | | | 2208 | | 6792 |
| Pay-out Percentage = 6792/8000 = 84.9% | | | | | | |
| Hit Frequency = 2208/8000 = 27.6% | | | | | | |

It may be noted that the change increases the WINS column for the combination BAR X X but decreases the WINS column for X BAR X and X X BAR combinations. This interaction is the reason that the Pay-out Percentage calculation is an iterative process. The designer must keep juggling values until the desired Pay-out Percentage is obtained. Adding a BAR to the third reel results in the table which follows:

| SYMBOLS | REEL 1 | REEL 2 | REEL 3 | WINS | PAY | COINS OUT |
|---|---|---|---|---|---|---|
| BAR X X | 3 | 18 | 17 | 918 | 2 | 1836 |
| X BAR X | 17 | 2 | 17 | 578 | 2 | 1156 |
| X X BAR | 17 | 18 | 3 | 918 | 2 | 1836 |
| BAR BAR BAR | 3 | 2 | 3 | 18 | 200 | 3600 |
| Total | | | | 2432 | | 8428 |
| Pay-out Percentage = 8428/8000 = 105.35% | | | | | | |
| Hit Frequency = 2432/8000 = 30.4% | | | | | | |

Thus, adding one BAR to the third reel has increased the Pay-out Percentage by more than 20% resulting in a losing game for the operator.

The situation becomes even more complex as the number of different symbol types increases. It can be seen that a machine having CHERRY, ORANGE, BELL, MELON, SINGLE BAR, DOUBLE BAR, TRIPLE BAR, and 7's on each reel strip results in a pay-out table which has grown in complexity. Trying to fine tune the Pay-out Percentage and the Hit Frequency provides a complex task.

Additionally, in prior art gaming apparatus there is no means provided wherein a player may select a pay schedule. For example, if the apparatus is set to only provide a jackpot, i.e., a Jackpot Only type of game there will be only one winning combination which is the multi-coin jackpot such as 200 coins. If the apparatus has a jackpot and lower value pays, which will have a higher frequency of occurence and a lower number of coins paid, such as two coins, the Hit Frequency (wins per play) for the jackpot will decrease if the overall Hit Frequency remains substantially the same. Similarly, if a game wherein there are intermediate value pays along with lower value pays and a jackpot, the Hit Frequency for any particular pay is determined and fixed. In order for a player to select a game having a different pay type, that is with more or less intermediate value pays, or more or less low value pays, and thus different win probabilities, the player presently must move to a different machine. There presently is no means for a player to select the pay type from that pre-existing in the machine, and for that matter, neither can the gaming facility operator, i.e., "The House." The latter would, of course, prefer to select the pay type in a machine as supply and demand dictates.

SUMMARY OF THE INVENTION

Accordingly, it is a primary object of the present invention to provide gaming apparatus wherein the overall Hit Frequency and Pay-out Percentage may be predetermined and a game is won or lost by generating a pseudo-random number from a set of random numbers unrelated to and substantially exceeding indicia on the gaming apparatus win/lose display, the game being a winner only if the number generated is equal to or less than the Hit Frequency, and if the game is a winner, another pseudo-random number is generated to determine the pay-out, the win/lose results being displayed in an entertaining manner.

It is another object of the present invention to provide gaming apparatus including rotatable reels for displaying winning and losing combinations of indicia, said apparatus comprising means for generating a substantially random number when a game is played which may be compared with a pre-selected Hit Frequency to determine whether the game is a winner or a loser, and if the game is a winner, another substantially random number is generated to determine the winning pay-out, the apparatus having means for rotating the reels to positions displaying a corresponding losing or winning combination of the indicia.

It is a further object of the present invention to provide rotating reel type gaming apparatus having random number generating means for generating a first number which determines whether a game is a winner or loser unrelated to indicia positions on the reels, the indicia positions being selected only after the determination that the game is a loser or, if the game is a winner, only after a second random number is generated which determines the value of the win.

It is a still further object of the present invention to provide gaming apparatus wherein a selected Hit Frequency and Pay-out Percentage may be fixed in memory, and wherein the probabilities of winning selected amounts may be calculated in accordance with selected pre-defined pay-out tables, the selection of a specific pay-out table being made at or prior to the time the game is played.

Accordingly, the present invention provides gaming apparatus including win/lose displaying means, such as a plurality of rotatable reels having indicia on the peripheries thereof which are set in motion when the game commences and which stop when the game ends, for visually displaying the results of the game. The gaming apparatus includes computer means including memory within which is stored fixed values of pre-selected Hit Frequency and Pay-out Percentage; together with a set of integer numbers which correspond to the Win Amounts, i.e., the value or amount provided or paid for a win; a set of winning display combinations, such as reel positions corresponding to indicia on a plurality of reels, associated with each of the Win Amounts; a set of losing display combinations, i.e., a display of combinations outside the winning display combinations; and in one form of the invention, a set of rational numbers known as the Win Probability Set such that each number corresponds with a Win Amount and is in the range of 0 to 1 and one number is the highest number in the range. In another form of the invention the memory rather than having a fixed Win Probability set stored therein, has a program which is accessed to calculate the Win Probability Set for at least two different pay value types, e.g., more or less intermediate value pays. The computer, which preferably is a microcomputer, includes random number generating logic for generating at least two different pseudo random numbers, i.e., numbers which are substantially random, hereinafter designated as random numbers, which lie between 0 and 1. The first number generated is compared to the Hit Frequency to determine whether the game played is a winner or loser and, if the game is a winner, the second number is generated and its value is compared to the numbers in the Win Probability Set to determine the Win Amount.

When a game is a loser the first random number or another generated random number may be multiplied by the integer number of elements in the set of losing display combinations to select one of the elements of the set of losing display combinations, and the selected losing display combination is displayed by the win/lose display means. When a game is a winner, the second random number or another generated random number may be multiplied by the integer number of elements in the set of winning display combinations and the selected winning display combination is displayed by the win/-lose display means.

The Win Probability Set may be readily determined from the pre-selected Hit Frequency and the Pay-out Percentage, and it may be determined for any particular selected pay type, i.e., either a game having only high or low value pays or a game having high, intermediate and low value pays or a game having any desired combination of pay values. Thus, the present invention provides means for determining and selectively setting the Win Probability Set by either the player or "The House" and this is accomplished without changing the Hit Frequency and the Pay-out Percentage.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENTS

Figure 1:
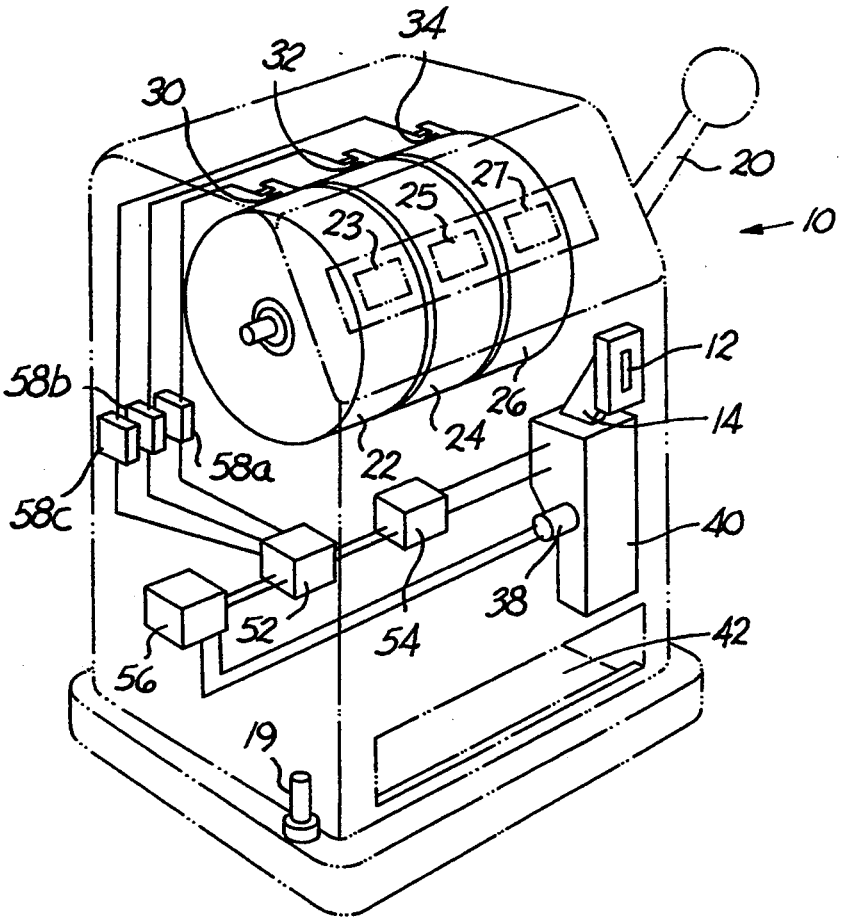
FIG. 1 is a diagrammatic perspective view of a reel type gaming apparatus within which the present invention preferably is incorporated.

Referring now to the drawings, FIG. 1 illustrates a preferred form of gaming apparatus 10 incorporating the principles of the present invention, the apparatus being of the well known reel type gaming apparatus known as a slot machine. Generally, and conventionally, one or more coins may be inserted into a slot 12 in a coin acceptor mechanism 14, and after it has been determined that the coin or coins are valid, a coin-in switch 16, illustrated in FIG. 2, activates circuitry to release a handle lock out mechanism 18, which may also be or include a play button switch 19. A handle or lever 20 is then enabled and may be rotated or the push button 19 depressed. This effects rotation of a plurality of annular wheels or reels 22, 24, 26, each of which has a plurality of indicia or symbols 23, 25, 27, such as bars, cherries, plums, etc. disposed about the periphery. Conventionally there are three or more such reels 22, 24, 26 in the form of annular shells rotatable about a common axis 28, each reel having 20 symbols 23, 25, 27 equally spaced apart positioned about the periphery. The initial or zero position of each reel is sensed by position sensing means which may be opto-sensor means including a light interrupter 30, 32, 34 on the periphery of the respective reel 22, 24, 26, the opto-sensor means being hereinafter further described, and the rotation of the reels are stopped at positions effected by the results of the game played so as to display combinations of indicia corresponding to the game results.

Scoring control and pay-out means 56, illustrated in FIG. 2, and hereinafter described, actuates a motor 38 to discharge coins from a hopper 40 if the game is a winner and coins corresponding to the pay-out are discharged from the pay-out hopper 40 through a coin pay-out mechanism 41 to a pay-out tray 42 at the front of the machine. The level of coins in the hopper 40 is sensed by a hopper coin detector 44 and when the hopper is full coins input into the slot 12 are diverted by mechanical diverter means 46 through a coin counter 48 to a drop box 50. Control of the functions of the machine in the prior art generally is through a computer (not illustrated) having programming for producing a random number generator for each reel for selecting a number corresponding to a reel position for each reel as described in the aforesaid Saxton et al and Telnaes patents, in the latter the random number generators selecting numbers corresponding to "virtual" positions which map back to actual positions on the reels. The random members generated then actuate mechanism through known circuitry to stop each reel in order. The computer also controls the releasing of the handle lock-out mechanism 18 when the coin-in switch 16 has been triggered and the coin has been accepted, controls a coin lockout device 17 and controls the starting and stopping of the reels, the determination of a winning or losing game and the disbursement of coins if there is a winner, and other functions such as when another game may be played.

Figure 2:
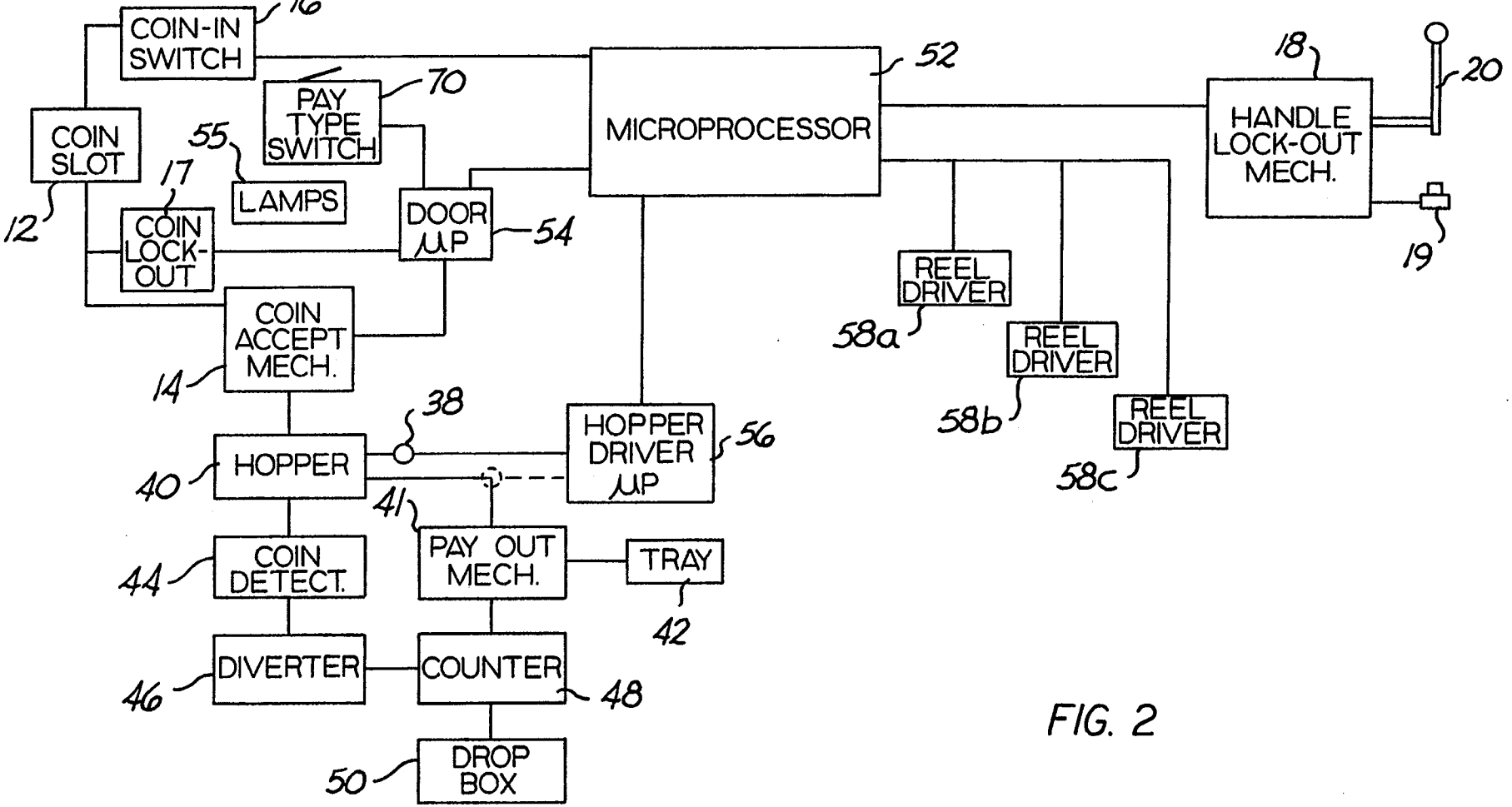
FIG. 2 is a block diagram of the gaming apparatus incorporating the invention.

In accordance with the preferred form of the present invention, and as illustrated in FIG. 2, the apparatus 10 in order to reduce the complexity of the interconnect harness required for the controls of the various functions and to reduce the failure rate and improve the security of the apparatus, utilizes a number of microcomputers rather than a single computer. Thus, the apparatus includes a primary microcomputer 52 which connects to and communicates with a variety of other microcomputers. For example, as illustrated the microcomputer 52 communicates with a door interface microcomputer 54, a hopper driver microcomputer 56, a series or reel driver microcomputers 58*a*, 58*b*, 58*c*, each corresponding to a respective reel 22, 24, 26, and preferably to a number of other microcomputers (not illustrated) which control the various game indicator and alarm lights, the bill validater and game monitoring and accounting devices. It may be stated that if the gaming apparatus includes more than three reels, a situation that is included within the scope of the present invention, additional reel drivers are required, there being one for each additional reel.

Figure 3:
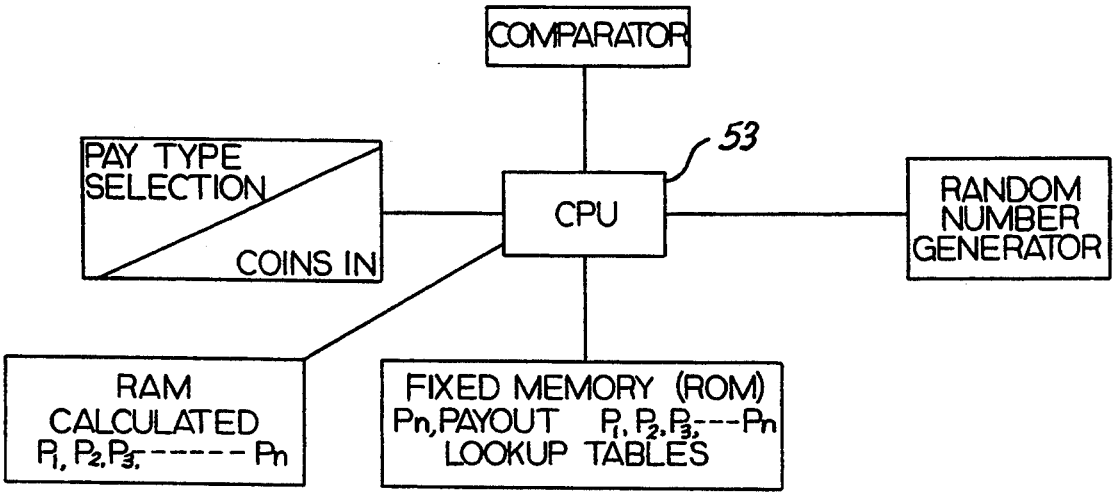
FIG. 3 is a block diagram of the CPU of the primary microcomputer and its memory illustrating certain functions performed and values stored.

The microcomputer 52, which may include a Phillips 80C552 microprocessor manufactured by Phillips and its Signetics, Inc. subsidiary of Sunnyvale, Calif. comprising the CPU, on a circuit board with read only program memory, i.e., ROM, preferably EPROM, of 64K capacity, which may be a Motorola 27C512 EPROM sold by Motorola Corporation of Phoenix, Ariz., random access memory, i.e., RAM of 32K capacity, such as a Dallas DS123OY sold by Dallas SemiConductor, Inc. of Dallas, Tex., and a serial bidirectional communications link to the other microcomputers. The microcomputer 52 includes the primary CPU 53 which is the microprocessor as aforesaid and performs the random number selection and the win/lose determination hereinafter described, and illustrated in block form in FIG. 3.

The door interface microcomputer 54 preferably comprises a single chip microprocessor containing on the chip a limited amount of EPROM program memory and RAM. A Phillips 87C652 microprocessor chip is an example of such a single chip microprocessor. The microcomputer 54 interfaces with a door security switch (not illustrated), the coin-in switch 16, a coin acceptor switch in the coin acceptor 14, and player command switches (not illustrated), the interfacing preferably being by means of optocouplers. Various lamps 55 in the lighted player switches and other assorted lamps which serve to attract play and communicate the state of the game to a player are also driven by means of the microcomputer 54. The microcomputer 54 gathers the various switch signals and transmits data as to the switch states to the microprocessor of the microcomputer 52 via the bi-directional serial communications link therebetween. The microcomputer 52 processes the information data corresponding to the various game states to the microcomputer 54 which processes this data and causes it to be displayed through the various lamps, etc.

The hopper driver microcomputer 56 comprises the hopper control and pay-out logic which includes a single chip microprocessor together with various triacs which control the hopper motor 38 to pay out coins when a winning game has been determined from the information it receives from the primary microcomputer 52. A Microchip PIC 16C54 microprocessor chip manufactured by Microchip Technology, Inc. of Chandler, Ariz. is an example of a single chip microprocessor which may function as the CPU of the microcomputer 56. The number of coins which have been paid is determined by a sensor (not illustrated) which provides one pulse to an input line of the microprocessor in the microcomputer 56. The microprocessor of the microcomputer 56 communicates through the bi-directional serial communications link to the primary microcomputer 52 so that it receives signals concerning the number of coins to be paid when there is a win, and after the pay-out logic and hopper control has effected the pay-out through the hopper motor 38, the information as to the pay-out is communicated to the primary microcomputer. If the hopper is empty or malfunctions and coins cannot be paid out, this information is also transmitted from the hopper driver microcomputer 56 to the microprocessor of the primary microcomputer 52.

Figure 4:
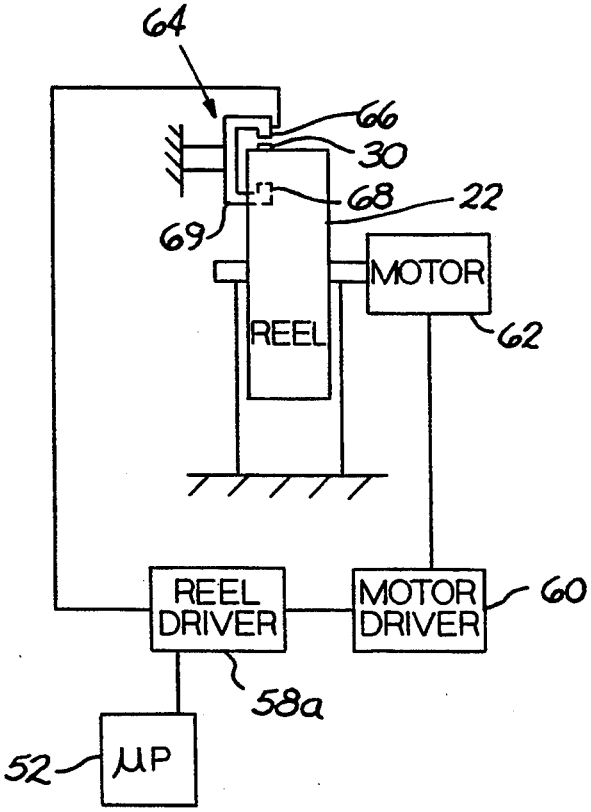
FIG. 4 is a block diagram of each reel driving mechanism constructed with the preferred form of the invention.

As aforesaid the primary microcomputer 52 also communicates with the reel drivers 58*a*, 58*b*, 58*c*, and any additional reel drivers corresponding to reels greater than the three reels 22, 24, 26 illustrated in conjunction with the preferred embodiment as described herein. Each reel driver microcomputer 58*a*, 58*b*, 58c comprises a single chip microprocessor with limited memory, such as a Microchip PIC 16C54, a motor driver 60 for amplifying the signal from the microprocessor for driving a motor 62 associated with each of the reels as, for example, reel 22 illustrated in FIG. 4. In the preferred form of the invention each motor 62 is a stepper motor and the motor driver 60 is a stepper motor driver. Preferably each stepper motor is disposed within the annulus of the respective reel. Associated with each reel driver microcomputer and reel such as the reel 22 is a zero position indicator generally indicated at 64, which preferably comprises a transmissive optosensor 66, a light source 68 and light interruptor 30 in the form of a tab affixed to the periphery of the reel at one edge in such a manner as to interrupt the transmissive optosensor light path once per revolution.

The indicator 64 is a conventional transmissive optosensor having the light source in the form of an LED mounted within the hollow of the reel adjacent the edge and facing the receiver or sensor which is adjacent to and external of the reel, the two components being carried on a U-shape arm 69. Thus, the indicator 64 is a rotary positional encoder which provides a pulse to the microprocessor of the reel driver each revolution of the reel with which it is associated. The microprocessor associated with the respective reel determines the position of the reel and provides this data to the primary microcomputer 52. This information is processed and retransmitted to set the reel initial position. The primary microcomputer 52 communicates with all of the microprocessors associated with the various reel drivers and provides a command to start all reels in motion after the microcomputer 52 has determined that the game is to commence by either rotation of the handle 20 or a depression of the push button 19. After the primary microprocessor 52 has calculated a random number and determines whether a winning game or losing game has resulted, and has determined an appropriate reel combination to display, as hereinafter described, the information is communicated to the respective microprocessor of each reel driver which counts the steps that the motor has made, i.e., the number of pulses received, and stops the rotation of the motor in accordance with the information received from the primary microprocessor. This is accomplished in sequence so that the primary microprocessor awaits information from each motor driver in succession to report that the associated reel has stopped successfully and then the primary microprocessor proceeds to address the subsequent drivers in seriatim. If a reel driver indicates that a fault has occurred, the primary microprocessor 52 sends a "tilt" indicator to the door interface microcomputer 54 and disables the game. When all of the reels stop successfully, a game complete signal is sent to the microcomputers 54 and 56 from the microcomputer 52 and to the respective reel drivers 58*a*, 58*b*, 58*c*, and if a winning game has been declared, the hopper driver microcomputer 56 is directed to pay the awarded number of coins.

It should be understood that rather than utilizing the primary microcomputer in conjunction with the microcomputers 54, 56 and the microprocessors in the reel drivers, a single microcomputer may be utilized to control and operate the entire system. As aforesaid, the preferred implementation of the invention reduces harness complexity and provides the other advantages aforesaid. It also permits a system peripheral to be redesigned to meet a new requirement rather than a redesign of the entire primary microprocessor as is conventional.

Programmed into and stored within the ROM memory of the primary computer 52 is a random number generator for generating a sequence of pseudo or substantially random fractions, i.e., random real numbers substantially uniformly distributed between 0 and 1. The methodology for programming random numbers is well known and various of such methods are illustrated in Section 3.2 of Volume 2 of the well known work by Donald E. Knuth entitled "The Art of Computer Programming" published in 1969, by Addison-Wesley Publishing Company, Inc. as part of the Addison-Wesley series in Computer Sciences and Information Processing.

Also programmed into and stored within the ROM of the microcomputer 52 is the desired Hit Frequency and Pay-out Percentages, the latter of which values is required by gaming regulators, such as the Nevada Gaming Commission, to remain fixed at a pre-approved value. The memory also includes a fixed pay table, that is the Win Amounts for each win as indicated on the machine, usually on a panel at the top of the machine. The Win Amounts are, of course, integers such as 2, 10, 100, etc. representing the number of coins won for the indicated win, and since these amounts must be fixed so that the pay table is fixed, these integers are also in the ROM.

The fixed memory or ROM may also include the Win Probability Set if a single pay type game is desired, but preferably the apparatus of the present invention has the capability of changing the Win Probability Set selectively by means of a pay type selecting switch 70 which interfaces with the microcomputer 52 through the microcomputer 54 or by means in response to the rate in which coins are inserted into the machine. In the latter case the Win Probability Set for the selected pay type is calculated and held in the RAM memory. The Win Probability Set, in either case, corresponds to a set of rational numbers corresponding to the probability of winning a particular amount should the game be a winning game, and is in the range of 0 to 1. Thus, a generated random number may be compared with each of the win probabilities in the Win Probability Set to determine whether it is smaller than each in sequence beginning with the smallest number of the set.

Programmed into the ROM memory are two sets of display combinations, i.e., a combination of reel positions. The first set is a set of winning display combinations associated with each win or pay out amount, while the second set is a set of losing display combinations. These display combinations may be in look-up tables addressed by the microprocessor of the microcomputer 52 and includes an index or address corresponding to a particular position or indicia on each of the reels. For example, a game having a Hit Frequency ($P_w$) of 20%, i.e., a probability of win of 0.2 and a Pay-out Percentage of approximately 94%, i.e., 0.94, may have a Pay-out or Pay Table as follows:

TABLE I

| Pay No. | Reel 1 | Reel 2 | Reel 3 | Win Value (coins) | Win Probability |
|---|---|---|---|---|---|
| 1 | cherry | X | X | 2 | 0.55 |
| 2 | cherry | cherry | X | 4 | 0.30 |
| 3 | Bar | Bar | Bar | 10 | 0.14 |
| 4 | 7 | 7 | 7 | 100 | 0.01 |

The X designates any symbol, i.e., any symbol may be disposed on the corresponding reel. The Win Value and Win Probability comprise the Win Probability Set. Moreover, since the bottom portion of the symbol on each reel above the symbol at the pay line or line of symbols which determine the results of a game and the top portion of the symbol below the pay line are generally visible to a player, in order to present winning, and also losing, combinations which are pleasing to the player and to give him or her the "feel" of the older mechanical or electromechanical type machines, it is desirable to not present the same combination for a particular Win Amount or a loser. Thus, for example, for the Pay Table, in conjunction with the 2 coin win amount at line #1, a particular listing of valid symbols may include the following Win Position Table:

TABLE II

| Position | Reel 1 | Reel 1 Pos. | Reel 2 | Reel 2 Pos. | Reel 3 | Reel 3 Pos. |
|---|---|---|---|---|---|---|
| 1 | cherry 1 | 1 | Plum 2 | 1 | Bar | 3 |
| 2 | cherry 2 | 7 | Bar | 1 | 7 | 2 |
| 3 | cherry 2 | 7 | Plum 1 | 1 | Bar | 3 |

Here, cherry 1 and cherry 2 designate first and second cherry symbols on reel 1. Similarly, this is true with regard to plum 1 and plum 2. The corresponding Look-up Table, which in accordance with the present invention is stored in the ROM memory of the microcomputer 52 may then be as follows:

TABLE III

| Index | Contents |
|---|---|
| 1 | 1,1,3 |
| 2 | 7,1,2 |
| 3 | 7,1,3 |

The index corresponds to the corresponding position number in the Win Position Table and provides an address in the Look-up Table. The contents are then communicated to the "microprocessor of the microcomputer 52 and used to supply signals to the reel drivers 58*a*, 58*b*, 58*c* so that the reels are stopped at the positions corresponding to the addressed contents. Thus, after the random number of a win selects one of the elements of the set of winning display combinations, as hereinafter explained, the contents of that set are addressed and the reels are stopped at the positions corresponding thereto.

Any combination of symbols not shown in the Pay Table as a winner, may be a losing combination. Thus, in this example a partial listing of losing positions will include the following:

TABLE IV

| Lose # | Reel 1 | Reel 1 Pos. | Reel 2 | Reel 2 Pos. | Reel 3 | Reel 3 Pos. |
|---|---|---|---|---|---|---|
| 1 | Bar | pos. 2 | Bar | pos. 2 | 7 | pos. 3 |
| 2 | 7 | pos. 3 | cherry | pos. 1 | Bar | pos. 2 |
| 3 | Bar | pos. 2 | Bar | pos. 2 | cherry | pos. 1 |
| 4 | 7 | pos. 3 | 7 | pos. 3 | Bar | pos. 2 |

Although the number of elements of losing positions shown here is only 4, it will be understood by those skilled in the art that normally there will be substantially more losing positions since, as aforesaid, it may be any combination not in the Pay Table. The more elements of losing positions that are utilized, the less frequency a combination shown for a particular losing element will be displayed. The corresponding look-up table which is stored in the memory may be as follows:

TABLE V

| Index | Contents |
|---|---|
| 0 | 2,2,3 |
| 1 | 3,1,2 |
| 2 | 2,2,1 |
| 3 | 3,3,2 |

Figure 5:
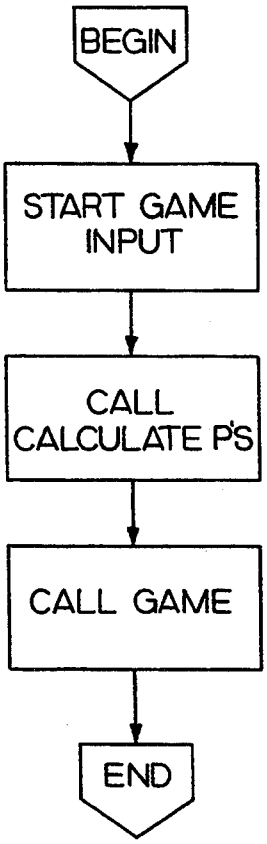
FIG. 5 is a flow chart diagram of the program for the start-up function of the microprocessor, and illustrates an embellishment of the invention.
Figure 6:
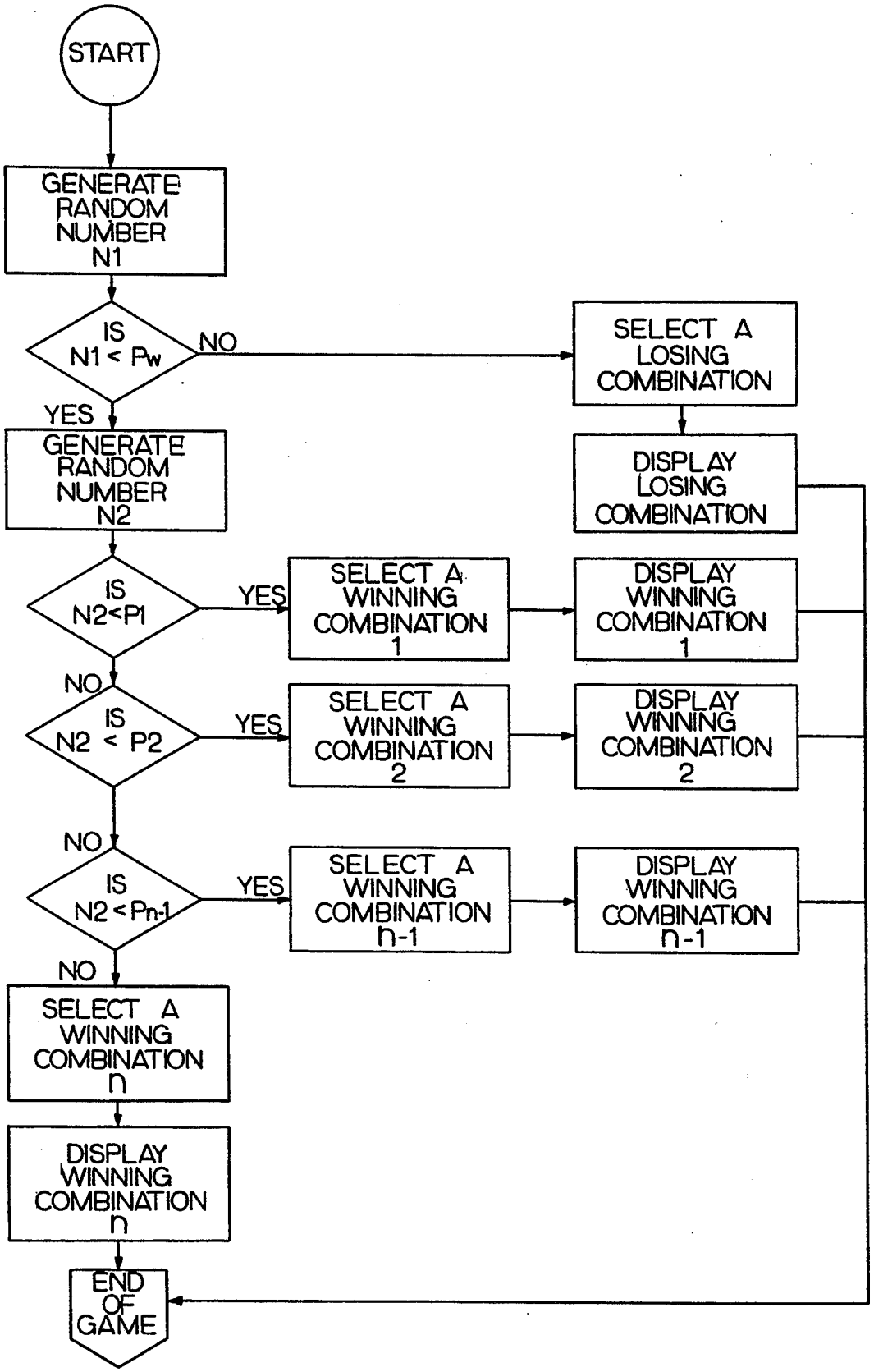
FIG. 6 is a flow chart diagram of the program for the microprocessor for controlling the playing of a game.

In one form of the invention the probabilities of winning any particular amount is fixed and stored in the ROM memory of the microcomputer 52. In other embodiments, as hereinafter described, the probabilities are calculated during or prior to the playing of the game and stored in the RAM memory of the microcomputer 52. In either of these cases, after a coin is inserted into the slot 12 to activate the coin-in switch 16 and the coin is accepted by the coin acceptor mechanism, this information is processed by the microcomputer 54 and communicated to the primary microcomputer 52. The microcomputer 52 processes this information and upon detecting that the coin is valid, provides and enabling signal to the lock-out mechanism 18 to release the handle lock-out for the handle 20 or to arm the play switch 19. The gaming apparatus or machine 10 is then ready to be played and after the maximum number of coins that may be played has been accepted by the apparatus, the coin lock-out control device 17 is actuated to prevent additional coins from being inserted until the present game has been played. The player initiates game play by pulling the handle 20 or depressing the play switch 19. The microcomputer 52 thereafter provides a handle lock-out and/or play switch disarming signal to the lock-out device 18 and provides signals to the reel drivers 58*a*, 58*b*, 58*c* to begin spinning the reels 22, 24, 26 by means of the respective motor 62. The flow of these steps is summarized in the start-up function flow chart of FIG. 5, and unless the pay type game is to be varied so that the probabilities are to be calculated, as hereinafter described, the program in the microcomputer 52 directs or calls the playing of the game in accordance with the steps illustrated in FIG. 6.

When all of the reels are spinning, the microcomputer 52 computes a random number $N_1$ in the range of 0 to 1. A summary flow chart for the program for effecting the game operation of the present invention is here illustrated in FIG. 6. As illustrated, this random number is queried by logic in the microcomputer 52 to compare it with the Hit Frequency $P_w$ stored in the ROM to determine if the generated number is more or less than the Hit Frequency. If it is equal to or more than the Hit Frequency, the game is a loser, and if less than the Hit Frequency the game is a winner. To illustrate, in the above example when the Hit Frequency is 0.2, the microcomputer compares the number $N_1$ with 0.2. If $N_1$ for illustration purposes is 0.3, the game is a loser since $N_1$ is greater or equal to the $P_w$ of 0.2. The microcomputer may then use the number $N_1$, or generate another random number $R_1$ in the range of 0 to 1, which it then multiplies by the integer number of elements in the table of losing positions. In the present example, using $N_1$ equal to 0.3 or assuming an $R_1$ of 0.3, this number is used to select a losing combination by multiplying it by 4, the integer number of elements in Table IV. The result is 1.2. The fractional portion of the result is discarded leaving a value of 1. The microcomputer 52 addresses the ROM memory and withdraws the contents 3,1,2 of Table V and transmits signals to the reel drivers 58*a*, 58*b*, 58*c* which in turn signal the motors 62 to begin to slow down the reels 22, 24, 26 in sequence so that they display the symbols indicated by position number 1, e.g., 7, cherry, Bar which is a losing combination. Since the game is a loser, the coin lock-out mechanism 17 is unlocked so that more coins may be accepted and the apparatus is ready for a new game. It may be noted that the only advantage of generating the additional random number $R_1$ is that additional numbers in the range below $N_1$ may be available for multiplying the integer number of losers. This may be advantages in certain cases to preclude the symbols representing the first losing number to be repeated frequently.

If, rather than $N_1$ being equal to or greater than the Hit Frequency $P_w$, it is less than the Hit Frequency, the game is a winner. Thus, in the above example, if the generated number $N_1$ is 0.15, the game is a winner since it is less than $P_w$ of 0.2. In this case the microprocessor 52 must then generate a second random number $N_2$ in the range of 0 to 1 which it then compares to the numbers P of the Win Probability in the Pay Table of Table I. The sequence for comparing $N_2$ against the Win Probability numbers begins with the smallest Win Probability, which in this example is position number 4 of the Pay Table. Thus, $P_1$ is 0.01, $P_2$ is 0.14, $P_n$ is 0.55 while $P_{n-1}$ is 0.30, where $P_n$ is the last number and is the highest Win Probability so that in this example n equals 4. Assuming that the microprocessor 52 generates a random number $N_2$ of 0.5, this number is compared in this case in the order of sequence to 0.01, 0.14, 0.30 and finally 0.55. Thus, here $N_2$ is not less than $P_1$, $P_2$, or $P_{n-1}$. As long as $N_2$ is not less than $P_{n-1}$, which in this example is 0.3, the winning combination will be determined by the Win Probability of $P_n$ which in this case is 0.55. The microcomputer 52 may then use that number $N_2$ or generate another random number $R_2$ in the range of 0 to 1, which it then multiplies by the integer number of elements in the Win Position Table, Table II. Thus, for the cherry, X, X two coin win, and assuming $N_2$ to be 0.50, or assuming an $R_2$ if such a number is generated to be 0.5, then the 0.5 is multiplied by 3, the integer number of elements in Table II thereby resulting in 1.50. The fractional part of the result is discarded and the integer part of the result, which here is 1, is selected. The microcomputer 52 then addresses the ROM memory to withdraw the contents 1,1,3 of Table III and transmits signals to the reel drivers 58*a*, 58*b*, 58*c* which signal the motors 62 to begin slowing down the reels 22, 24, 26 in sequence so that they display the winning combination cherry 1, plum 1, BAR. Of course, for a real world machine there would be more combinations in Table II than illustrated except for the lower probability, high pay wins. In those cases, and possibly in all cases, $N_2$ may be used to access directly the contents of Table III, and similar tables for the higher pay wins, without the multiplication and discarding steps described above. It should also be noted that rather than paying the larger amounts when $P_1$ is the lowest value in the sequence, the second random number may be compared in the reverse order and pay the larger wins when it is greater than $P_1$.

The microcomputer 52 also instructs the hopper control microcomputer 56 of the winning amount so that the microcomputer 56 may control the hopper motor 38 to pay out the number of coins won. The win, of course, could also be in the form of a ticket in which case the microcomputer 56 would cause a ticket of corresponding value to be printed. The award could also be escrowed by the game and added to the value currently in the game escrow account. The primary microcomputer 52 also instructs the door interface microcomputer 54 to direct the unlocking of the coin lock-out 17 so that more coins may be accepted for a new game.

A primary advantage of the apparatus of the present invention over the prior art game determination is simplification of calculation and the capability of fine tuning the Hit Frequency and the Pay-out Percentage of the game, since the Win Probabilities are determined by a simple calculation from the equation:

Hit Frequency × the sum of expectations for each pay amount = the Pay-out Percentage. Thus, $$P_w[(pay1 \times P_1)+(pay2 \times P_2)+(pay3 \times P3) \ldots +(payn \times Pn)] = P.O.\% \times coinsplayed.$$

To illustrate, with the Hit Frequency ($P_w$) of 20%, i.e., 0.2 and a Pay-Out Percentage (P.O.%) of 0.94, if a game pays 200 coins when there is a win showing BAR, BAR, BAR, and pays 2 coins when there is a win of BAR, X,X or X, BAR, X or X, X, BAR with no other wins, then to determine the probability $P_1$ of hitting the 200 coin pay and the probability $P_2$ of hitting a 2 coin win when playing one coin, reduces to $$0.2(200P_1+2P_2)=0.94(1).$$

Since the sum of all probabilities must be equal to 1, assuming a win, then $$P_2=1-P_1.$$

Thus, the equation becomes $$0.2[200P_1+2(1-P_1)]=0.94$$

and $P_1=0.013636$ which is the probability of a BAR, BAR, BAR win and $P_2=0.98634$ which is the probability of either a BAR, X, X or X, BAR, X or X, X, BAR win.

In a real world gaming apparatus, a pay table with BAR symbols, as in the above example, would also include the 2 BAR combinations BAR, BAR, X; BAR, X, BAR and X, BAR, BAR. Typically such a win will be in the order of 10 coins. The equation then becomes:

$$0.2(200P_1+10P_2+2[1-P_1-P_2])=0.94(1)$$

Where $P_1$ and $P_2$ are defined in the above example. This reduces to $198P_1+8P_2=2.7$. Thus, there is one equation with two unknowns so that there are a set of solutions and to solve for $P_1$, $P_2$ may be assumed. Assuming $P_2$ to be 10% or 0.1, $P_1$ may be determined by the equation to be 0.009596 which is thus the probability of a 200 coin win and $P_3$ is 0.890404, the probability of a 2 coin win. It should be understood that the probability of winning a given amount is only meaningful if the game is a winning game, and this fact is determined by the Hit Frequency, $P_w$. If a higher value for a two BAR win is picked, the probability of obtaining a three BAR win is reduced, as is the probability of a one BAR win. Consequently, with the same Hit Frequency and the same Pay-out Percentage, the game may be varied to have more or less intermediate pay wins. In accordance with the present invention, this permits a game operator or a player to select more or less intermediate pays as desired. To provide this feature, a feature not possible in the prior art, the present invention provides two alternate methods of selecting the type of pay of a winning game, thereby permitting the game to be varied to provide more or less intermediate pays.

Figure 7:
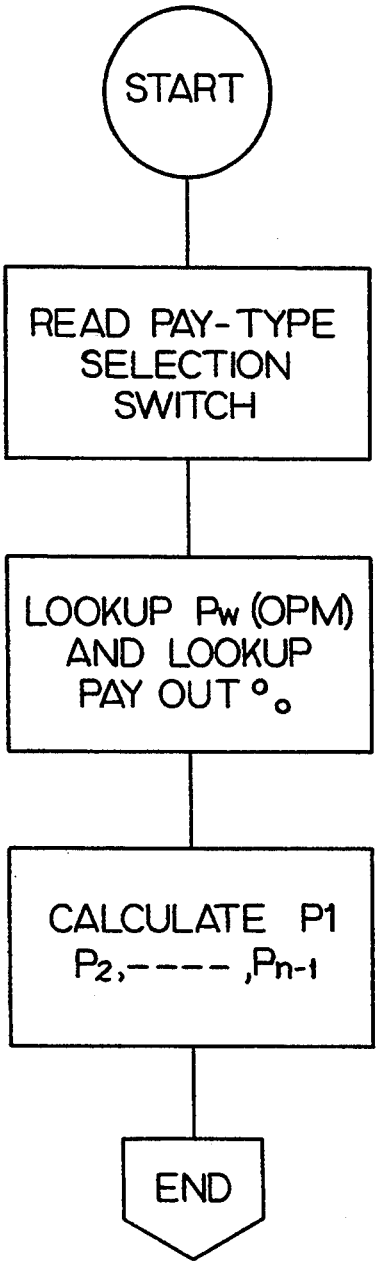
FIG. 7 is a flow chart diagram of the program for a first embodiment of the embellishment illustrated in FIG. 5.

In one form of the invention, this may include the pay selector switch 70 which may be mounted either at the front of the apparatus 10 accessible to a player or may be mounted on the back of the apparatus for access to the game operator only. When the switch 70 is activated to one position the probabilities $P_1$, $P_2$, and $P_3$, as in the above example, may be calculated to provide a greater amount of intermediate pays and when in the other position the probabilities $P_1$, $P_2$ and $P_3$ may be calculated to provide a lesser amount of intermediate pays. In the first case the assumed value of $P_2$ is greater than in the latter, and in the latter, $P_2$ may even be assumed to be 0 so that there would be no intermediate pays as in the earlier example above. The value of $P_2$, and any other assumed probabilities for games of various intermediate pays, may be stored in the ROM preferably associated with the primary microcomputer 52 or may be associated with the door interface microcomputer 54. The door interface microcomputer with which the switch 70 is interfaced, informs the primary microcomputer 52 of the state of the switch 70 as illustrated in FIG. 7. The microcomputer 52 then addresses the ROM to read the instructions and values for calculating the probabilities using the stored values of $P_w$ and Pay-out Percentage and with the appropriate assumed stored values of $P_2$. The values of $P_1$, $P_2$, $P_3$ . . . Pn are thereafter stored in the RAM associated with the microcomputer 52 and these values are then used for comparison with the random number $N_2$ generated if the game is a winner.

Figure 8:
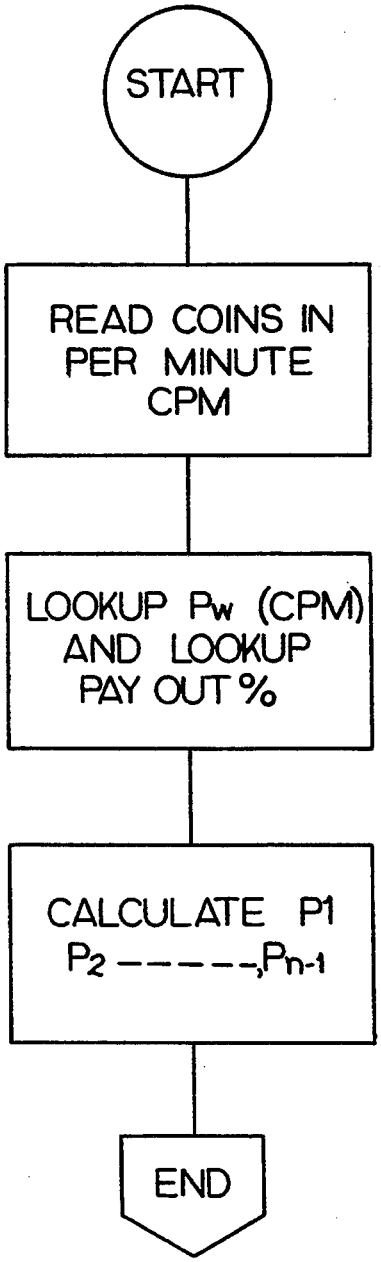
FIG. 8 is a flow chart diagram similar to FIG. 7, but of a second embodiment of the embellishment illustrated in FIG. 5.
Figure 9:
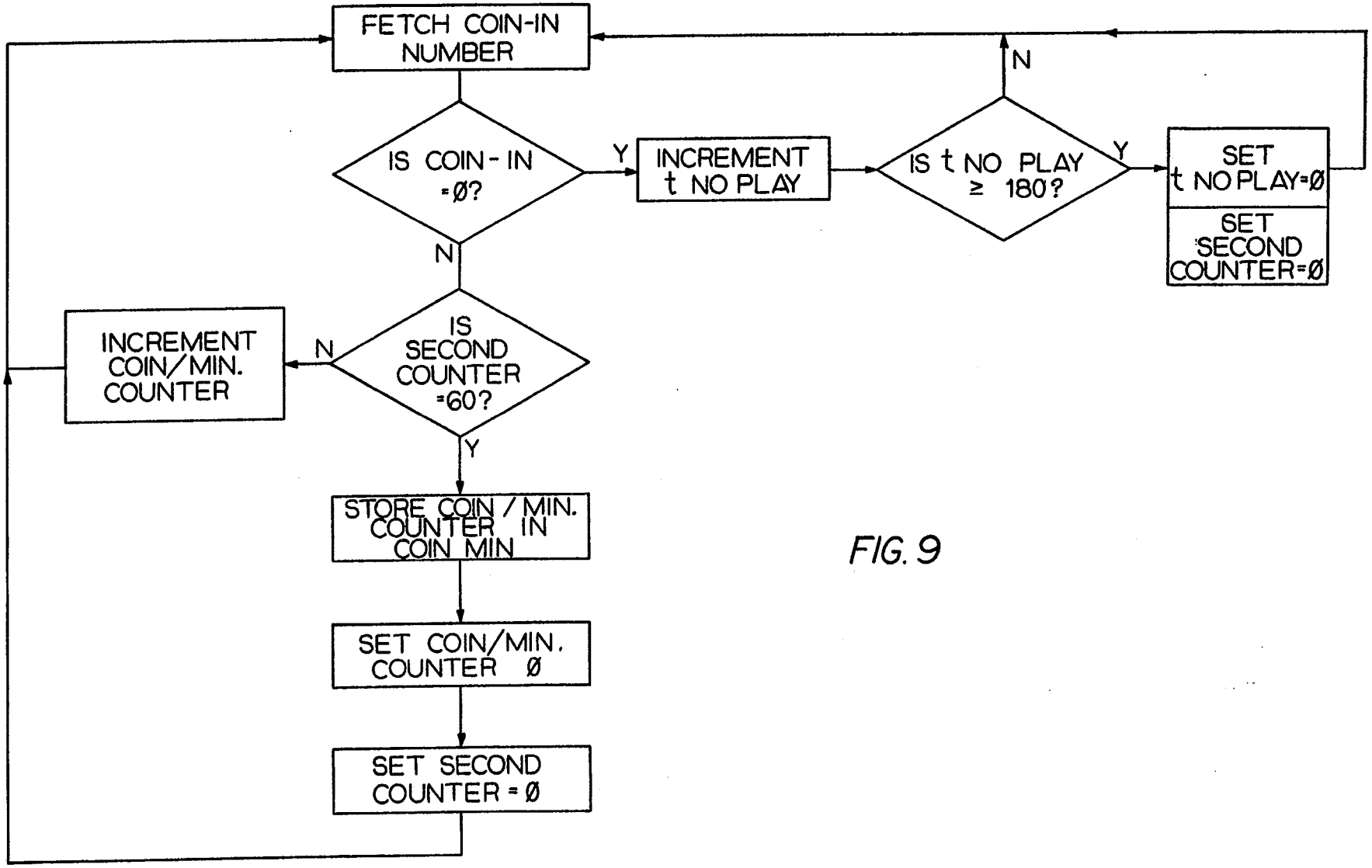
FIG. 9 is a flow chart diagram of a sub-routine in the program illustrated in FIG. 8.

Another form of selecting the type of pay of the game may be performed without player or operator interface, but may be determined by the rate at which coins are inserted into the apparatus. Thus, when coins are inserted into the slot 12 the coin-in switch 16 provides information to the microcomputer which is stored in RAM memory where it may be fetched on command and used by the microprocessor of the microcomputer 52 as an instruction to address the ROM for obtaining appropriate assumed values $P_2$ and others if desired, and instructions for calculating the win probability as illustrated in the flow diagram of FIG. 8. Thus, if the rate at which coins are inserted is rapid, the intermediate pays may be increased, reduced or deleted as desired. The routine for reading the rate at which coins are inserted into the apparatus determines a value for coins per minute as illustrated in the flow diagram of FIG. 9. This routine effects the coin-in switch 16 to determine whether one or more coins have been inserted into the slot. If no coins have been inserted, a no play seconds counter in RAM, which is updated every second, is incremented and if no coins have been inserted for three minutes, i.e., 180 seconds, the seconds counter is set to 0. When coins are inserted into the apparatus, a seconds count location in RAM is read and queried by the microprocessor to determine if a minute has elapsed between insertions, if not a coins per minute location in RAM is incremented. If it is determined that a minute has elapsed since a coin was inserted, the value of coins inserted during the prior minute is stored in a location in RAM and updated every minute. The coin per minute counter and the seconds counter are then set to 0. The stored value of coins per minute is then used by the microprocessor of the microcomputer 52 as aforesaid to calculate the Win Probabilities used in the game.

Consequently, the gaming apparatus of the present invention determines the random number, compares this random number against the Hit Frequency and if the generated random number preferably is less than the Hit Frequency, the game is a winner. If it preferably is more than the Hit Frequency, the game is a loser. Of course whether the game is a loser or a winner may be determined by the reverse, i.e., if the random number is greater than the Hit Frequency the game may be a winner, etc. If the game is a winner a second random number is generated and compared against the Win Probabilities for specific win amounts to determine how much is won. When the results of the game have been determined, the reels are stopped to show symbols corresponding to either a losing combination or a winning combination in the Pay Table. Variations in the Win Probability may be provided in accordance with the present invention by either a player, a game operator, or may be provided in response to the rate in which coins are inserted into machines.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. Gaming apparatus comprising, a plurality of reels mounted for rotation about an axis, said reels having peripheral surfaces on which indicia are disposed indicative of angular positions of the respective reel, means for starting rotation of said reels, means for assigning a preselected hit frequency value representative of the probability of a winning game, means for generating a first random number, means for comparing said random number with said hit frequency value to determine whether the game played is a winning game or is not a winning game, means for stopping rotation of said reels at angular positions displaying indicia representing a losing game when the game played is determined not to be a winning game, means for generating a second random number whenever said game played is determined to be a winning game, means for assigning a plurality of numbers defined as win probabilities each representative of the probability of winning a respective win value, means for comparing said second random number in sequence with said win probabilities to determine the value of a win if the game played when a winning game, and means for stopping rotation of said reels at angular positions displaying indicia representing the value of the win.

2. Gaming apparatus as recited in claim 1, wherein said means for assigning said hit frequency value and said win probabilities includes memory means for fixedly storing said values.

3. Gaming apparatus as recited in claim 1, wherein said means for assigning said win probabilities includes means for calculating at least first and second different sets of win probabilities, and operator influenced means for selecting one of said sets of win probabilities for a particular game played.

4. Gaming apparatus as recited in claim 3, wherein said operator influenced means comprises a selection switch.

5. Gaming apparatus as recited in claim 1, wherein said means for starting rotation of said reels and for stopping rotation of said reels includes a respective drive motor associated with each reel, and computer means for providing start and stop signals for each motor.

6. Gaming apparatus as recited in claim 5, wherein said computer means includes memory means for storing reel position instructions corresponding to a plurality of losing combinations of indicia on said reels and to winning combinations of indicia on said reels, one of said losing combinations being accessed when the game played is a losing game, and one of said winning combinations being accessed when the game played is a winning game.

7. Gaming apparatus as recited in claim 1, wherein said first random number is in the range of 0 to 1.

8. Gaming apparatus as recited in claim 7, wherein said second random number is in the range of 0 to 1.

9. Gaming apparatus comprising, display means for displaying a combination of indicia, means for storing a preselected fixed hit frequency value representative of the probability of having a winning game, means for generating a first substantially random number in the range of 0 to 1, means for comparing said random number with said hit frequency, means for selecting only a losing combination for display by said display means when said random number is more than said hit frequency, means for generating a second random number only when said first random number is less than said hit frequency, means for comparing said second random number with a plurality of win probabilities corresponding to respective different win values to select a winning value, and means for selecting a winning combination for display by said display means corresponding to said winning value.

10. Gaming apparatus as recited in claim 9, including pay selection means for selecting one of a series of different pluralities of win probabilities so that win values may be varied for games played by said apparatus.

11. Gaming apparatus as recited in claim 9, wherein said means for selecting a losing combination comprises memory means for storing a plurality of sets of losing combinations, and computer means for selecting one of said sets.

12. Gaming apparatus as recited in claim 9, wherein said display means comprises a plurality of reels rotatable about a common axis to different angular positions, each reel having a plurality of indicia, and means for starting rotation of said reels upon commencement of a game and for stopping rotation of said reels to display selected winning and losing combinations.

13. Gaming apparatus as recited in claim 12, wherein said means for starting rotation of said reels and for stopping rotation of said reels comprises a stepper motor connected to each reel, and computer means for directing each stepper motor to start and to stop.

14. Gaming apparatus as recited in claim 9, wherein said means for selecting a winning combination comprises memory means for storing a plurality of sets of win combinations corresponding to each win probability, and computer means for selecting one of said sets.

15. Gaming apparatus as recited in claim 14, wherein said means for selecting a losing combination comprises memory means for storing a plurality of sets of losing combinations, and computer means for selecting one of said sets.

16. Gaming apparatus as recited in claim 15, wherein said display means comprises a plurality of reels rotatable about a common axis to different angular positions, each reel having a plurality of indicia, and means for starting rotation of said reels upon commencement of a game and for stopping rotation of said reels to display selected winning and losing combinations.

17. Apparatus as recited in claim 16, wherein said means for starting rotation of said reels and for stopping rotation of said reels comprises a stepper motor connected to each reel, and computer means for directing each stepper motor to start and to stop.

18. The method of operating gaming apparatus having a plurality of like-symbol displaying means to produce and display game results wherein the ratio of the number of winning games to the total number of games played is a constant defined as hit frequency, and for displaying the results of winning and losing games by said displaying means, said method comprising generating a first substantially random number, comparing said random number with said hit frequency to determine whether said random number is more or less than said hit frequency, selecting and displaying a symbol on each of said plurality of displaying means defining only a losing game when said random number is more than said hit frequency, generating a second substantially random number only when said first random number is less than said hit frequency, comparing said second random number with a plurality of numbers corresponding to the probability of winning different amounts, and selecting and displaying a symbol on each of said plurality of displaying means defining an winning game of the winning amount.

19. In gaming apparatus, the method of controlling the display of a symbol on each of a plurality of rotatable reels each having a plurality of symbols so that a combination of symbols indicative of winning and losing games may be displayed, said method comprising, storing a value representative of the probability of a game being a winning game defined as the hit frequency, said probability being expressed as the decimal equivalent of the ratio of winning games to total games played, generating a first random number in the range of 0 to 1, comparing said random number to said hit frequency, selecting only a losing combination for display from a set of losing combinations when said random number is more than said hit frequency, generating a second random number only when said first random number is less than said hit frequency, and selecting a winning combination for display from a plurality of sets of winning combinations when the second random number is generated.

* * * * *